US005608921A

United States Patent [19]

Barrett et al.

[11] Patent Number: 5,608,921

[45] Date of Patent: Mar. 11, 1997

[54] CHILD'S TOILET SEAT ASSEMBLY FOR USE WITH AN ADULT-SIZED TOILET

[76] Inventors: Larry J. Barrett; Nancy B. Barrett, both of 1470 Turkey Pen La., Lenoir City, Tenn. 37772

[21] Appl. No.: 526,514

[22] Filed: Sep. 11, 1995

[51] Int. Cl.[6] ..... A47K 13/00

[52] U.S. Cl. ..... 4/239

[58] Field of Search ..... 4/234–237, 239, 4/240

[56] References Cited

U.S. PATENT DOCUMENTS

| | | | |
|---|---|---|---|
| Re. 32,807 | 12/1988 | Adams | 4/235 |
| D. 35,798 | 6/1902 | Barrett | D23/311 |
| D. 306,899 | 3/1990 | Miller | D23/296 |
| D. 309,176 | 7/1990 | Sessions | D23/296 |
| 468,086 | 7/1887 | Colombani | 4/240 |
| 722,465 | 3/1903 | Sudbrink | 4/235 |
| 1,196,427 | 8/1916 | Brandenburg . | |
| 1,701,115 | 2/1929 | McKinney | 4/235 |
| 2,221,991 | 11/1940 | Myers et al. | 4/239 |
| 2,544,792 | 3/1951 | Jack | 4/239 |
| 2,693,602 | 11/1954 | Meath | 4/235 |
| 2,808,874 | 10/1957 | Liebling | 155/131 |
| 3,590,402 | 7/1971 | Penley | 4/239 |
| 4,516,279 | 5/1985 | Block | 4/235 |
| 5,141,354 | 8/1992 | Morsbach | 4/239 X |

FOREIGN PATENT DOCUMENTS

| | | | |
|---|---|---|---|
| 2268777 | 1/1994 | United Kingdom | 4/236 |

*Primary Examiner*—Charles E. Phillips

[57] ABSTRACT

A child's toilet seat assembly includes a mount which is attachable to the toilet bowl of a common adult-sized toilet and a child's seat body which is securable to the mount in a snap-fit relationship therewith. The mount includes a base having wing sections which are securable to the bowl with bolts used to secure the adult-sized seat atop the upper rim of the toilet bowl and rounded portions which are maintained in an elevated condition above the base. The child's seat includes a body having portions which cooperate with the rounded portions of the mount to permit the body of the child's seat to be interfitted with the mount in a snap-fit relationship therewith. When joined together, the body of the child's seat can be pivoted between raised and lowered positions without interfering with the movement of or the use of the adult-sized seat. Accordingly, the child's seat assembly can be left permanently attached to the adult-sized seat to permit the user of the toilet to select between the adult-sized seat or the child's seat or easily removed.

16 Claims, 4 Drawing Sheets

CHILD'S TOILET SEAT ASSEMBLY FOR USE WITH AN ADULT-SIZED TOILET

BACKGROUND OF THE INVENTION

This invention relates generally to toilets and relates, more particularly, to the means and mechanisms by which a child's toilet seat is attached to an adult-sized toilet.

Although there exists means for attaching a child's toilet seat directly to the seat of an adult toilet, such prior art means fails to accommodate the attachment of a child's toilet seat directly to the bowl of an adult toilet.

For example, it is known in the prior art that a child's toilet seat can be attached to a toilet bowl by utilizing adhesive-backed strips attached between the adult seat and the child's seat. For example, in U.S. Pat. No. 4,516,279, an adhesive is attached to an adult toilet seat, and a child's seat having a pair of extension arms are securable to the adhesive in a manner permitting the child's seat to be raised and lowered. It is believed that such an arrangement requires a relatively heavy-duty adhesive which cannot be readily removed without damaging the finish of the adult seat.

It is also known that pin-bearing spindle can be utilized for securing a child's toilet seat to an adult toilet seat. For example, the child's toilet seat illustrated in U.S. Pat. Des. No. 35,798 relies on the use of a spindle having pins for securement of the spindle to the hinge of the adult seat, and the child's seat is, in turn, securable to the spindle. These small pins produce small holes in the hinges of the adult seat, and these holes remain in the hinges when the spindle is subsequently removed.

Other multiple seat arrangements are disclosed in U.S. Pat. No. Re. 32,807, U.S. Pat. Des. No. 309,176, and U.S. Pat. No. 4,680,816 wherein a child's toilet seat is permanently attached to an adult seat by way of a common hinge. Such arrangements normally involve the separate manufacture of a child's seat, an adult seat and a lid which each share the same hinge. Such multiple seat arrangements are likely to be relatively costly to produce and thus relatively costly to purchase. Moreover, since the child's seat is permanent fixture in the assembled arrangement, the child's seat cannot be easily removed from the remainder of the arrangement. Still further, such arrangements are intended to replace the existing adult seat, rather be attachable to the existing adult seat.

It is accordingly an object of the present invention to provide a new and improved child's toilet seat assembly which is attachable to the toilet bowl of an adult-sized toilet without removing the adult seat and can be readily attached and detached from the bowl.

Another object of the present invention is to provide such an assembly which is used in conjunction with the adult seat yet does not damage or interfere with the use of the adult seat.

Still another object of the present invention is to provide such an assembly having a hinge mechanism which is securable to the toilet bowl with the same fasteners normally used for securing the adult toilet seat to the toilet bowl.

Yet another object of the present invention is to provide such an assembly which is easy to attach to an adult toilet and is relatively economical to produce.

SUMMARY OF THE INVENTION

This invention resides in a child's toilet seat assembly for attachment to an adult toilet including a bowl having an upper rim having an upwardly-directed surface, an adult toilet seat, and means for hingedly connecting the adult toilet seat to the bowl to accommodate the movement of the adult toilet seat between raised and lowered positions. The hingedly connecting means of the adult toilet includes at least one fastener having a head and a shank which extends downwardly into the upwardly-facing surface of the rim.

The seat assembly includes a child's toilet seat including a body adapted to overlie the seat of an adult toilet when the adult toilet seat is in a lowered position, and also includes attachment means for hingedly securing the body of the child's toilet seat to the bowl of the adult toilet. The attachment means includes a platen portion securable between the head of the fastener of the hingedly connecting means of the adult toilet and the upper rim of the toilet bowl and a body portion for cooperating with the body of the child's toilet seat to accommodate the securement of the body of the child's seat and the body portion of the attachment means in a snap-fit relationship.

DETAILED DESCRIPTION OF THE ILLUSTRATED EMBODIMENTS

Figure 1:
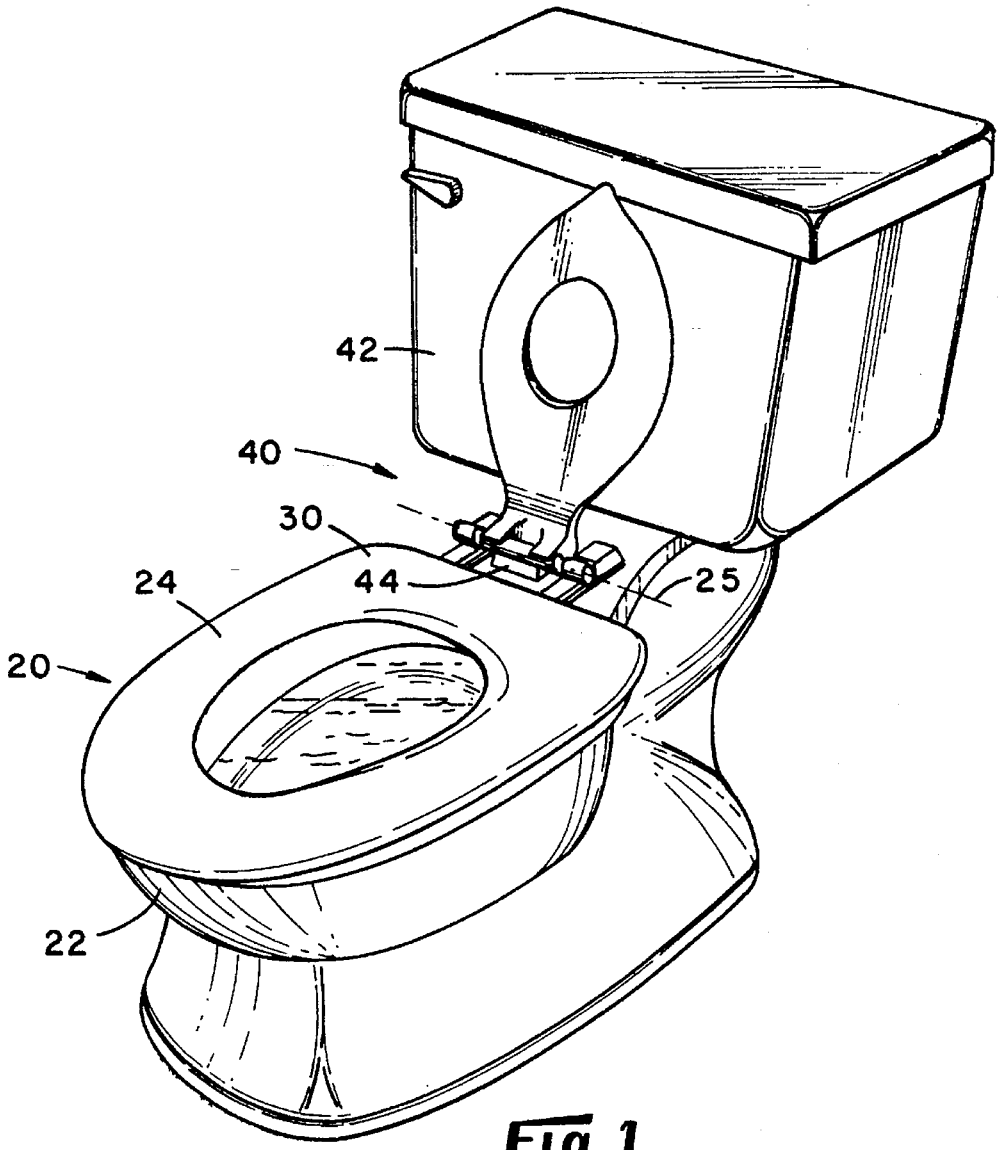
FIG. 1 is a perspective view of an adult toilet to which an embodiment of a child's toilet seat assembly is attached.

Turning now to the drawings in greater detail, there is shown in FIG. 1 an adult-sized toilet 20 having a bowl 22 and an adult-sized seat 24 attached atop the bowl 22. The seat 24 is hingedly connected to the toilet bowl 22 by way of a hinge assembly 28 for pivotal movement relative to the bowl 22 between a lowered position (depicted in FIG. 1) and a raised position. Attached to the bowl 22 is a child's seat assembly 40 having a seat 42 and a mount 44 with which the seat 42 is joined to the bowl 22 for pivotal movement between the raised position (depicted in FIG. 1) and a lowered position. When attached to the bowl 22 of the adult toilet 20, the toilet 20 is rendered more easily usable by a child.

Figure 2:
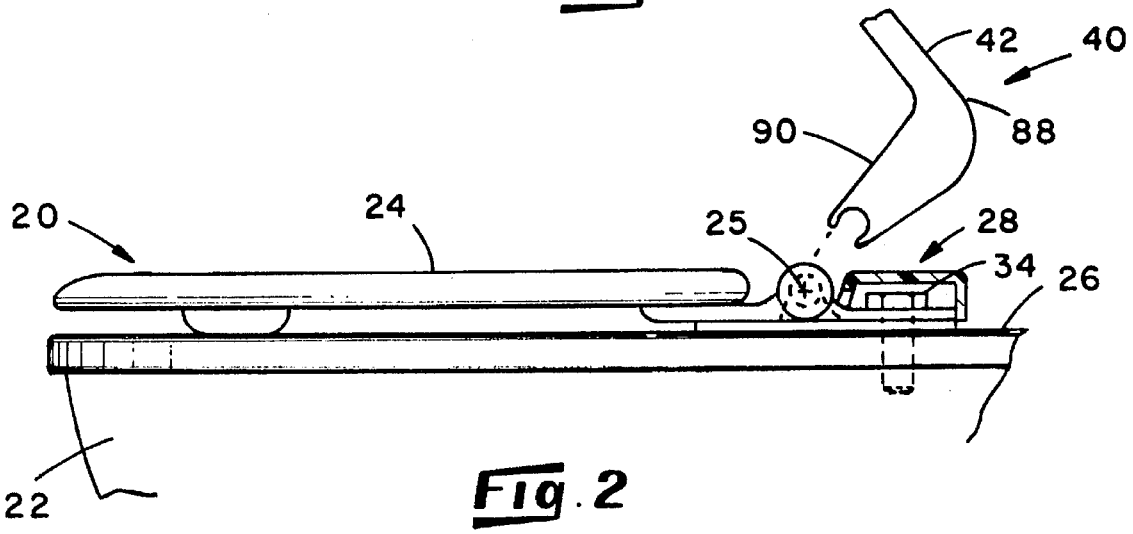
FIG. 2 is a side elevational view of a fragment of the FIG. 1 toilet shown with the child's seat being detached from the remainder of the assembly and shown partly cut-away.
Figure 3:
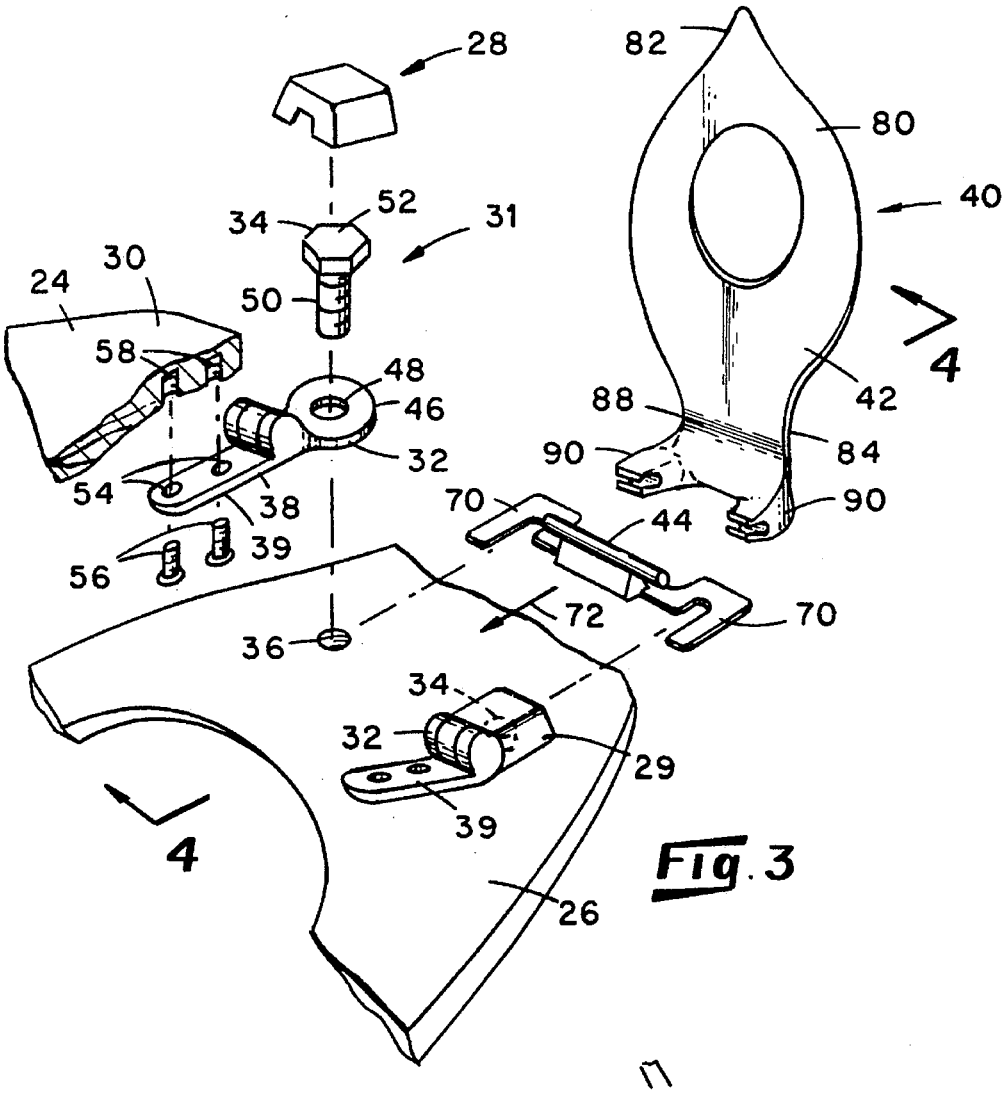
FIG. 3 is a perspective view of a fragment of the FIG. 1 toilet and child's seat assembly, shown exploded.

With reference to FIGS. 1–3, the toilet bowl 22 has a body having an upwardly-directed planar rim 26, and the hinge assembly 28 is interposed between the back portion, indicated 30, of the seat 24 and the upper rim 26 of the bowl 22. As best shown in FIG. 3, the hinge assembly 26 includes a pair of hinge arrangements 29 wherein each arrangement 29 is disposed adjacent a corresponding side of the bowl 22. As exemplified by the arrangement 29 depicted in FIG. 3 in an exploded condition, each of the two arrangements 29 includes a stationary hinge member 32 securable to the toilet bowl 22 and a pivot member 38 securable to the toilet seat 24 and joined to the stationary member 32 for pivotal movement about an axis 25 (FIGS. 1 and 2). The stationary member 32 includes an eyelet portion 46 having an opening 48 for accepting the shank 50 of the bolt 34 (which includes a head 52 and an elongated threaded shank 50), and the pivot member 38 has an elongated portion 39 having holes 54 defined therein. The eyelet portion 46 is secured to the toilet bowl 22 as the shank 50 of the bolt 34 is directed through the eyelet opening 48 and tightened within an internally-threaded opening 36 provided along the upper rim 26 of the bowl 22. The eyelet portion 46 is thereby tightly held against the bowl 22 between the surface of the upper rim 26 and the head 52 of the bolt 34.

The pivot member 38 is secured to the toilet seat 24 with screws 56 which extend through the holes 54 provided in the elongated portion 39 and are tightened within aligned internally-threaded holes 58 provided in the underside of the seat 24. An optional cap 59 may be secured over the head 52 of the bolt 34 to hide the bolt head 52 from view. With the stationary hinge members 32 securely attached atop the upper rim 26 and the pivot members 38 securely attached to the back portion 30 of the toilet seat 24, the seat 24 is permitted to pivot relative to the bowl 22 between raised and lowered positions about the pivot axis 25.

Figure 4:
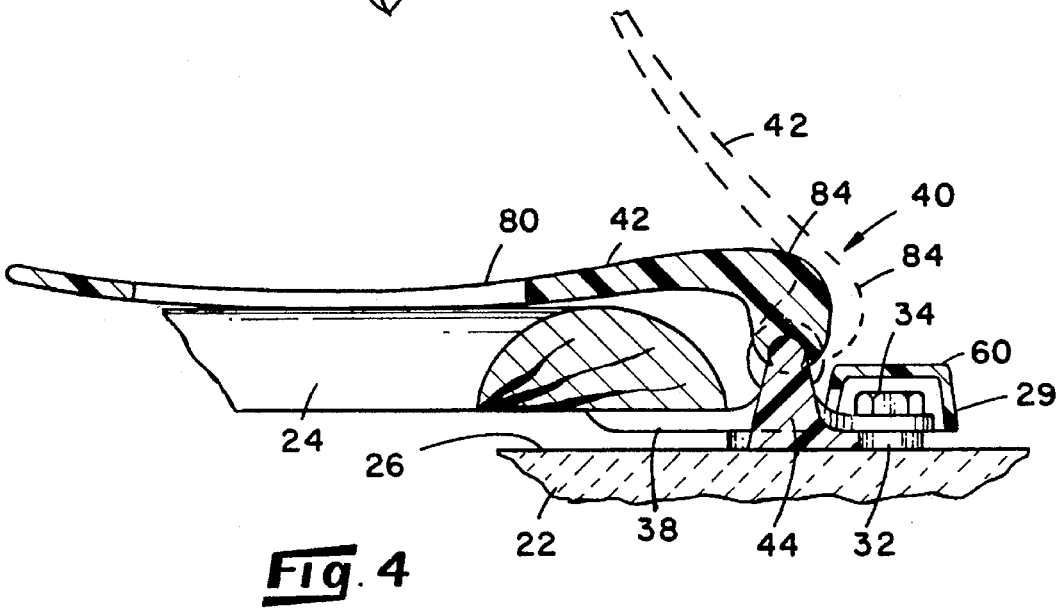
FIG. 4 is a cross section of a fragment of the FIG. 1 toilet and child's seat assembly taken about along line 4—4 of FIG. 3.
Figure 5:
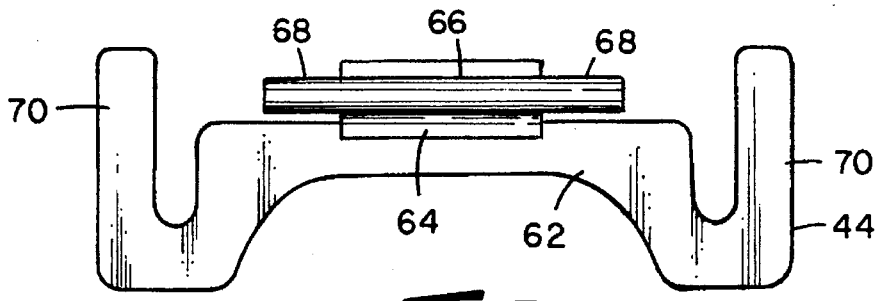
FIG. 5 is a plan view of the mount of the child's seat assembly of FIG. 1.
Figure 6:
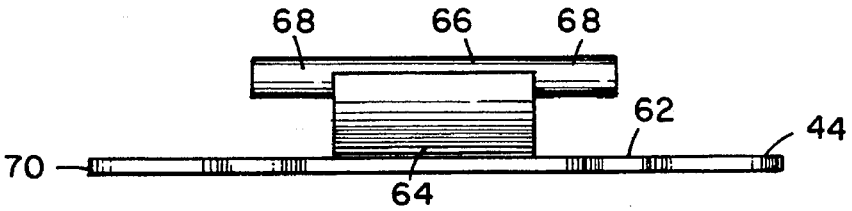
FIG. 6 is an elevational view of the FIG. 5 mount as seen from below in FIG. 5.
Figure 7:
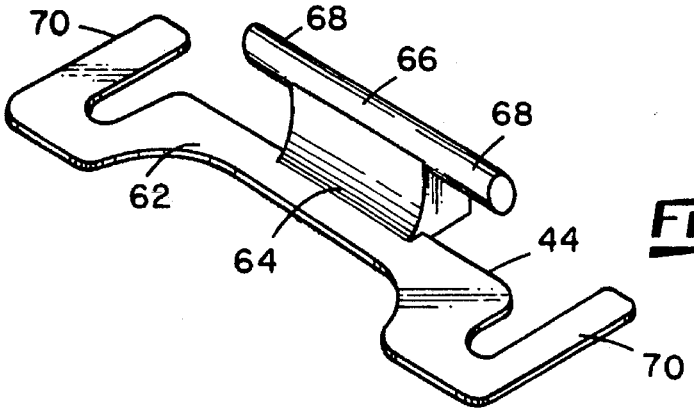
FIG. 7 is a perspective view of the FIG. 5 mount.
Figure 8:
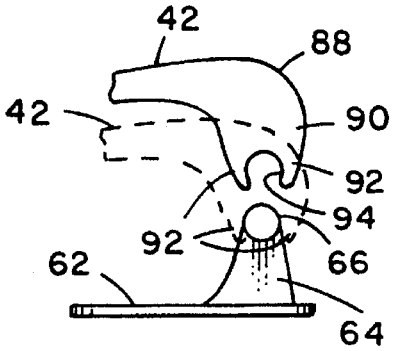
FIG. 8 is a side elevational view of the child's seat assembly of FIG. 1, shown exploded.

With reference to FIGS. 3 and 4, the seat 42 and the mount 44 of the child's seat assembly 40 are hingedly connectable together for movement relative to one another about an axis of pivot. When the seat assembly 40 is attached to the toilet 20 in a manner described herein, the mount 44 is fixed in a stationary condition relative to the toilet bowl 22, and the body of the seat 42 is pivotally joined to the mount 44.

As best shown in FIGS. 5—8, the mount 44 includes a central body portion 60 and a platen base portion 62 joined to the central body portion 60. The central body portion 60 includes a section 64 having a somewhat triangular cross section and an upper rod-like section 66 joined atop the triangular section 64. The rod-like section 64 includes two opposite rounded, i.e. cylindrical, end portions 68 which are axially aligned and which extend away from opposite sides of the triangular section 64 for a reason which will be apparent herein.

The platen base portion 62 includes a pair of laterally-extending wing sections 70 which are each shaped to define a U which opens away from the same side of the mount 44. The U of each U-shaped wing section 70 is adapted to accept the shank 50 of a corresponding bolt 34 when directed sidewise therein. Accordingly, the distance between the legs of each U is slightly larger than the diameter of the bolt shank 50 about which the U is positionable. In the depicted assembly 40, the central body portion 60 and the platen base portion 62 of the mount 44 are integrally formed together out of a relatively hard plastic, as in a molding operation, but the mount 44 may be constructed out of other suitable materials.

To secure the mount 44 to the toilet bowl 22 and with reference again to FIG. 3, the bolts 34 are loosened, but not completely removed, from the openings 36 to raise the heads 52 thereof to a spaced condition above the surface of the upper rim 26. The mount 44 is then positioned rearwardly of the bolt heads 52 so that the underside of the base portion 62 of the mount 44 rests upon the upper rim 26 and the space between the U of each wing section 70 opens toward a side of the shank 50 of a corresponding bolt 34 (as shown in FIG. 3). The mount 44 is subsequently moved forwardly of the bowl 22, i.e. in the direction of the arrow 72 of FIG. 3, so that the U of each U-shaped wing section 70 accepts the shank 50 of a bolt 34. Accordingly, the distance between the Us of the wing sections 70 generally corresponds to the distance between the two bolt shanks 50.

Once the U-shaped wing sections 70 are positioned about the bolt shanks 50 so that the longitudinal axis of the rod section 66 of the central body portion 60 is substantially aligned with the pivot axis 25, the bolts 34 are tightened within the openings 36 to securely hold the mount 44, as well as the corresponding hinge arrangement 29, in place against the surface of the upper rim 26 as shown in FIG. 4.

With reference again to FIG. 3, the seat 42 of the child's seat assembly 40 includes a ring-like portion 80 having a opening 82 positioned substantially centrally therein and wherein the portion 80 is shaped so as to be comfortable when seated upon by a child. Furthermore, the body of the seat 42 is of such size to rest upon and be partially supported by the adult-sized seat 24 of the toilet 20 when positioned thereon as shown in FIG. 4. Accordingly, the body of the seat 42 is sized so that at least its perimeter portion overlies at least a portion of the ring of the adult seat 24 when resting thereupon. In addition, the ring-like portion 80 of the seat 42 includes a front 82 which corresponds with the front of the toilet 20 and an opposite back 84.

Associated with the back 84 of the body of the seat 42 are means, generally indicated 86, for cooperatively interfitting with the mount 44 in a snap-fit relationship to accommodate a hinged movement of the seat 42 between a raised and a lowered condition. In the depicted embodiment 40, the interfitting means 86 includes a body portion 88 including two spaced jaw-providing sections 90 wherein each jaw-providing section 90 includes two jaws 92 (FIG. 8) defining a C-shaped recess 94 therebetween. It is a feature of the body 88 that each of its C-shaped recess 94 is adapted to accept a corresponding end portion 68 of the rod section 66 of the mount 44 when the jaws 92 are forcibly urged thereabout. Accordingly, the distance between the (free) ends of the jaws 92 are slightly smaller than the diameter of the end portion 68 of the rod section 66 which it is intended to accept.

The body of the seat 42 is preferably formed, such as in a molding operation, out of a relatively hard plastic which provides the jaws 92 of the jaw-providing sections 90 with a degree of flexibility. Therefore, during an attachment operation during which the jaws 92 are forcibly urged against the cylindrical end portions 68, the ends of the jaws 92 are permitted to flex outwardly to accommodate the passage of the end portions 68 therebetween, and when the end portions 68 are fully received by the C-shaped recesses 94, the jaws 92 return to the original, unflexed condition to releasably hold the end portions 68 within the recesses 94.

As mentioned earlier in connection with the attachment of the mount 44 to the toilet bowl 22, the mount 44 is preferably secured to the bowl 22 so that its rod section 66 is axially aligned with the pivot axis 25 (FIGS. 1–3) of the adult-sized seat 24. Thus, when the child's seat 42 is secured to the mount 44 in the aforedescribed manner, the seat 42 is permitted to pivot relative to the toilet bowl 22 about the pivot axis 25 between a lowered position as illustrated in solid lines in FIG. 4 and a raised position as illustrated in phantom in FIG. 4. The advantage provided by such a feature is that the each of the child's seat and the adult-sized seat 24 can be raised or lowered about the pivot axis 25 without interference from the other thereby accommodating the selection of the adult seat 24 or the child's seat 42 for use.

Figure 9:
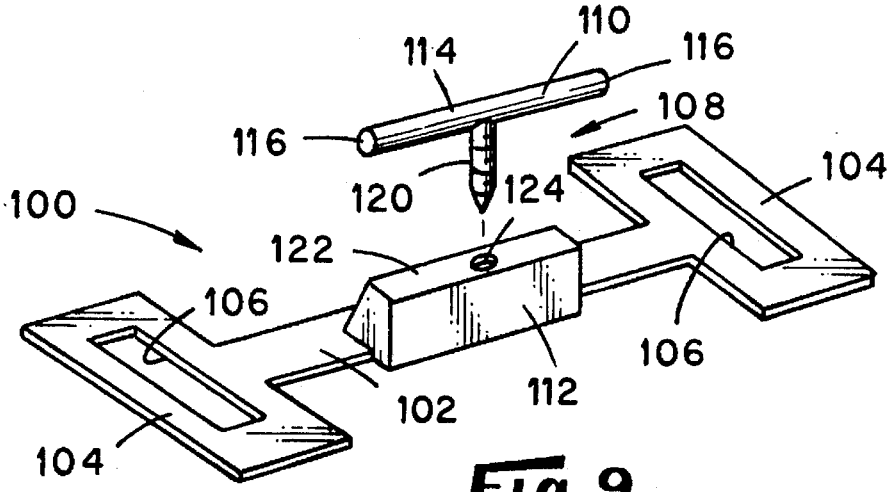
FIG. 9 is a perspective of an alternative embodiment of a mount for use in a child's seat assembly.

With reference to FIG. 9, there is shown an alternative embodiment, indicated generally 100, of a mount which can be used in place of the mount 44 in the child's seat assembly. The mount 100 includes a platen-like base 102 having wing sections 104 wherein each wing section 104 defines an opening 106 for accepting the shank 50 of the FIG. 3 bolt 34 when the shank 50 is directed endwise therethrough. To install the FIG. 9 mount 100, each bolt 34 has to be completely removed and then reinstailed in place through a corresponding opening 104, but such a mount 100 may be preferred over the U-shaped sections of the mount 44 to reduce the likelihood that the mount 100 may be inadvertently dislodged from the bowl 22.

The mount 100 of FIG. 9 also includes a central portion 108 comprised of two upper and lower sections 110 and 112, respectively, which are joined together in a manner which permits the upper and lower sections 110, 112 to be moved relative to one another between alternative positions. More specifically, the upper section 110 includes a rod-like section 114 having opposite cylindrical end portions 116,116 adapted to be received by the C-shaped recesses 94 provided in the jaw-providing sections 90 of the seat 42 and a downwardly-depending threaded shank portion 120 joined to the rod-like section 114. The lower section 112 includes a body having an upwardly-directed surface 122 within which is defined an internally-threaded opening 124 for threadably accepting the shank portion 120 of the upper section 110.

To adjust the height of the rod-like section 114 relative the platen base 102 while the shank portion 120 is threadably received by the opening 124, the shank portion 120 (and the attached rod-like portion 114) are rotated in one direction or the other about a vertical axis so that the upper section 110 is moved upwardly or downwardly relative to the lower section 112 to a desired position. Such a mount 100 facilitates the alignment of the rod-like section 114, and hence the pivot axis of the child's seat assembly, with the pivot axis of an adult-sized toilet seat whose pivot axis may be disposed at a different height from the upper rim of the bowl than that of an adult seat with which the mount 44 is adapted to be used.

It follows from the foregoing that a child's toilet seat assembly has been described wherein the assembly includes a mount securable atop the upper rim of an adult-sized toilet bowl in a manner which does not interfere with the movement or use of the adult-sized toilet seat positioned upon the rim and a child's seat which is, in turn, releasably securable to the mount in a snap-fit relationship. Therefore, the child's seat assembly may be left permanently attached to an adult-sized toilet, or the child's seat may be detached from the mount while the mount remains attached to the toilet bowl. Further, the child's toilet seat assembly is advantageous in that it utilizes the bolts and openings used to attached the adult-sized seat to the bowl and can be installed so that its seat fits over an adult-sized seat which may already be in place. Further still, the means by which the child's seat body is joined to the mount in a snap-fit relationship permits the seat body to be attached or detached from the toilet bowl without damage to the adult-sized seat or to the toilet bowl. In addition, the seat assembly is relatively inexpensive to produce, is easy to install and is convenient to use.

Figure 10:
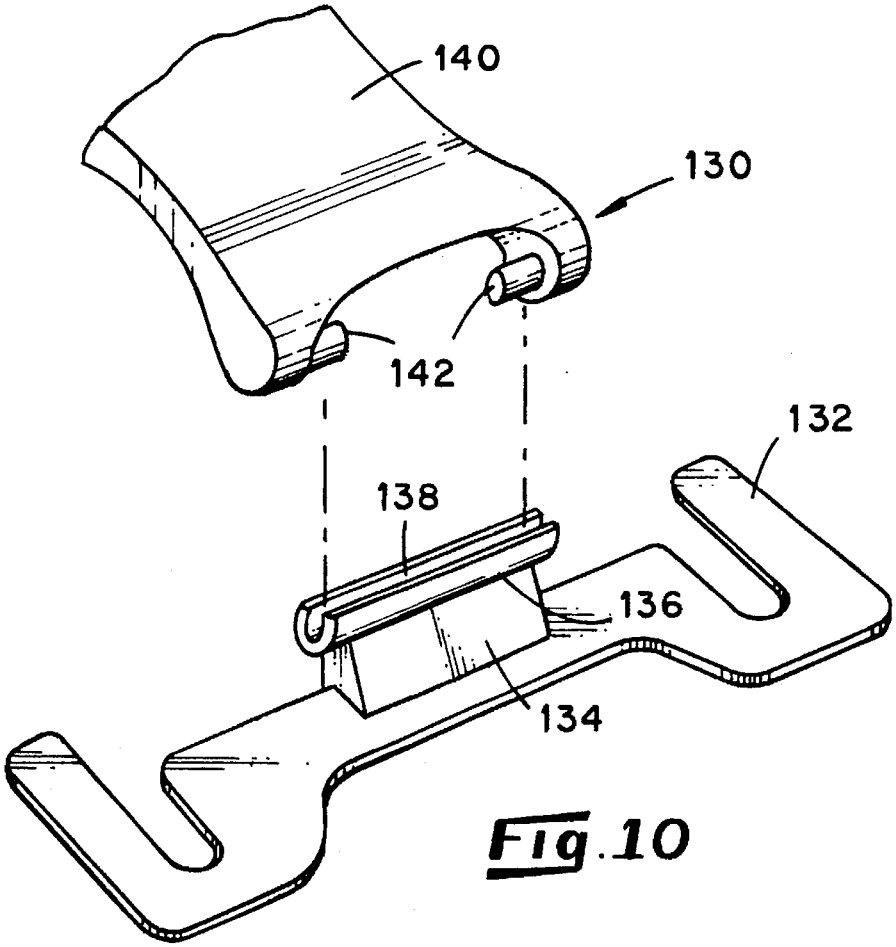
FIG. 10 is an alternative embodiment of a child's seat assembly.

It will be understood that numerous modifications and substitutions can be had to the aforedescribed embodiment without departing from the spirit of the invention. For example, although the aforedescribed embodiment 40 has been shown and described as comprising a mount 44 having cylindrical portions 68 and a seat 42 having jaw-providing sections 90 for releasably accepting the cylindrical portions of the mount 44, an embodiment in accordance with the broader aspects of the invention can include a seat body having cylindrical portions and a mount having jaw-providing sections for releasably accepting the cylindrical portions of the seat body. For example, there is shown in FIG. 10 an assembly embodiment 130 comprising a mount 132 having a central portion 134 with which is associated an elongated jaw-providing section 136 having an upwardly-opening C-shaped recess 138. The assembly 130 also includes a child's seat 140 having a body which defines a pair of cylindrically-shaped protuberances 142 adapted to be releasably received by the C-shaped recess 138 of the mount 132 in snap-fit relationship therewith.

Furthermore, although the mount 44 of the assembly embodiment 40 has been shown and described as including a rod-like section 66 which is integrally joined to the remainder of the mount 44, a mount may include a rod-like section which is detachable from the remainder of the mount 44. Accordingly, the aforedescribed embodiment is intended for the purpose of illustration and not as limitation.

We claim:

1. A child's toilet seat assembly for attachment to an adult toilet including a bowl having an upper rim having an upwardly-directed surface, an adult toilet seat, and means for hingedly connecting the adult toilet seat to the bowl to accommodate the movement of the adult toilet seat between raised and lowered positions and wherein the hingedly connecting means includes at least one fastener having a head and a shank which extends downwardly into the upwardly-facing surface of the rim, the assembly comprising:

a child's toilet seat including a body adapted to overlie the seat of an adult toilet when the adult toilet seat is in a lowered position, and attachment means for hingedly securing the body of the child's toilet seat to the bowl of the adult toilet including a) a platen portion securable between the head of the fastener of the hingedly connecting means of the adult toilet and the upper rim of the toilet bowl and b) a body portion for cooperating with the body of the child's toilet seat to accommodate the securement of the body of the child's seat and the body portion of the attachment means in a snap-fit relationship.

2. The seat assembly as defined in claim 1 wherein one of the body of the child's seat and the body portion of the attachment means includes means providing a rounded section and the other of the body of the child's seat and the body portion of the attachment means includes means for receiving the rounded section in a snap-fit relationship.

3. The seat assembly as defined in claim 2 wherein the rounded section and the receiving means cooperate with one another so that when fitted together in a snap-fit relationship, the body of the child's seat is hingedly joined to the attachment means for movement relative thereto between a raised position and a lowered position.

4. The seat assembly as defined in claim 3 wherein the means for receiving includes means defining a recess for releasably accepting the rounded section.

5. The seat assembly as defined in claim 4 wherein the recess-defining means is associated with the body of the child's seat and the rounded section is associated with the body portion of the attachment means.

6. The seat assembly as defined in claim 4 wherein the recess-defining means is associated with the body portion of the attachment means and the rounded section is associated with the body of the child's seat.

7. The seat assembly as defined in claim 1 wherein the platen portion is adapted to be secured between the head of the headed fastener and the surface of the upper rim of the toilet bowl.

8. The seat assembly as defined in claim 7 wherein the shank of the headed fastener is externally threaded and is threadably received within an internally-threaded opening provided in the upper rim of the toilet bowl and wherein the platen portion includes a U-shaped section having a U which is adapted to accept the shank of the headed fastener when directed edgewise thereabout so that by loosening the headed fastener to expose the shank of the fastener, directing the U of the U-shaped section about the shank of the fastener and then tightening the headed fastener, the platen portion is securely retained between the head of the fastener and the upper rim of the bowl.

9. The seat assembly as defined in claim 7 wherein the shank of the headed fastener is externally threaded and is threadably received within an internally-threaded opening provided in the upper rim of the toilet bowl and wherein the platen portion defines an opening therein for accepting the shank of the fastener when directed endwise therein so that by directing the shank of the fastener endwise through the opening of the platen portion and tightening the fastener within the internally-threaded opening provided in the upper rim, the platen portion is securely retained between the head of the fastener and the upper rim of the bowl.

10. The seat assembly as defined in claim 1 wherein the adult toilet seat is pivotal relative to the toilet bowl about a single axis of pivot, and the attachment means is adapted to hingedly secure the body of the child's toilet seat to the bowl of the adult toilet to accommodate the pivotal movement of the child's seat about said single pivot axis.

11. In a child's toilet seat assembly having a child's seat for use with an adult toilet including a bowl having an upper rim having an upwardly-directed surface, an adult toilet seat, and means for hingedly connecting the adult toilet seat to the bowl and wherein the hingedly connecting means includes a pair of headed fasteners each having a head and a shank which extends downwardly into the upwardly-directed surface of the upper rim and wherein the child's seat is adapted to overlie the adult toilet seat when used therewith, the improvement comprising:

attachment means for securing the child's toilet seat to the bowl of the adult toilet including a platen portion securable to the upper rim of the toilet bowl with the headed fasteners and a body portion, and the child's seat includes means which cooperatively interfit with the body portion of the attachment means so that the child's seat is releasably interlocked with the body portion of the attachment means in a hinged snap-fit relationship.

12. The improvement as defined in claim 11 wherein one of the body portion of the attachment means and the cooperatively interfitting means of the child's seat includes a rounded section and the other of the body portion of the attachment means and the cooperatively interfitting means includes means providing a pair of jaws and a recess disposed between the jaws for releasably accepting the rounded section when the jaws are urged thereabout.

13. The improvement as defined in claim 12 wherein the rounded section has a diameter, and the jaws have free ends which are slightly smaller than the diameter of the rounded section and possess a degree of flexibility to accommodate a flexing of the free ends of the jaws away from one another when forcibly urged about the rounded section so that the rounded section is seated within the recess disposed between the jaws.

14. The improvement as defined in claim 13 wherein the platen portion and the body portion of the attachment means are integrally joined together.

15. The improvement as defined in claim 11 wherein the adult toilet seat is pivotal relative to the toilet bowl about a single axis of pivot, and the attachment means is adapted to hingedly secure the body of the child's toilet seat to the bowl of the adult toilet to accommodate the pivotal movement of the child's seat about said single pivot axis.

16. The improvement as defined in claim 15 wherein the attachment means is adapted to hingedly secure the body of the child's toilet seat to the bowl of the adult toilet to accommodate the pivotal movement of the child's seat about one pivot axis and the attachment means includes means for adjusting the height of the one pivot axis relative to the upper rim of the bowl to accommodate the arrangement of the one pivot axis in aligned relationship with the single pivot axis.

* * * * *